US009422752B2

(12) United States Patent
Rosenau et al.

(10) Patent No.: US 9,422,752 B2
(45) Date of Patent: Aug. 23, 2016

(54) MOTOR VEHICLE DOOR WITH TAMPER-PROOF SAFETY MECHANISM

(71) Applicant: GM GLOBAL TECHNOLOGY OPERATIONS LLC, Detroit, MI (US)

(72) Inventors: Mark Rosenau, Schornsheim (DE); Peter Eduard Schuessler, Hoesbach (DE); Andreas Heberer, Mainz (DE); Winfried Langendorf, Wiesbaden (DE); Joerg Gschweng, Mainz (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 96 days.

(21) Appl. No.: 14/090,371

(22) Filed: Nov. 26, 2013

(65) Prior Publication Data

US 2014/0159396 A1 Jun. 12, 2014

(30) Foreign Application Priority Data

Nov. 28, 2012 (DE) ..... 10 2012 023 656

(51) Int. Cl.
*E05B 17/00* (2006.01)
*E05B 77/44* (2014.01)
*E05B 83/36* (2014.01)

(52) U.S. Cl.
CPC ..... *E05B 77/44* (2013.01); *E05B 83/36* (2013.01); *Y10T 292/79* (2015.04)

(58) Field of Classification Search
USPC ..... 292/346
See application file for complete search history.

(56) References Cited

U.S. PATENT DOCUMENTS

| | | | | |
|---|---|---|---|---|
| 5,477,712 | A * | 12/1995 | Hill | 70/417 |
| 5,697,238 | A | 12/1997 | Oike | |
| D500,947 | S * | 1/2005 | Czerwinski | D8/314 |
| D659,507 | S * | 5/2012 | Metz et al. | D8/343 |
| 8,579,339 | B2 * | 11/2013 | Abe | 292/336.3 |
| 8,925,361 | B2 | 1/2015 | Granny et al. | |
| 2005/0046237 | A1 | 3/2005 | Miyoshi et al. | |
| 2006/0119114 | A1 * | 6/2006 | Kreitz et al. | 292/346 |
| 2008/0185850 | A1 | 8/2008 | Takaya et al. | |

FOREIGN PATENT DOCUMENTS

| | | | |
|---|---|---|---|
| DE | 29507235 | U1 | 7/1995 |
| DE | 19941907 | A1 | 3/2000 |
| DE | 20111158 | U1 | 10/2001 |
| DE | 10361873 | A1 | 7/2004 |
| DE | 19964507 | A1 | 1/2007 |

(Continued)

OTHER PUBLICATIONS

German Patent Office, German Patent Search Report for Application No. 102012023656.5, dated Sep. 20, 2013.

(Continued)

*Primary Examiner* — Mark Williams
(74) *Attorney, Agent, or Firm* — Ingrassia Fisher & Lorenz PC

(57) ABSTRACT

A motor vehicle door is provided with a supporting door structure and with a door lock as well as with an actuating unit, which, spaced from the door lock, is arranged on the door structure and mechanically coupled to the door lock with at least one connecting link, and with a holding part supporting itself on the door structure, which is designed in order to limit a position change of the actuating unit caused due to external application of force.

14 Claims, 3 Drawing Sheets

(56) References Cited

FOREIGN PATENT DOCUMENTS

| | | | |
|---|---|---|---|
| DE | 102008011754 | A1 | 9/2009 |
| EP | 0297057 | A1 | 12/1988 |
| EP | 1176271 | A2 | 1/2002 |
| EP | 69914899 | T2 | 1/2005 |
| WO | 2011120682 | A1 | 10/2011 |

OTHER PUBLICATIONS

Intellectual Property Office, Search Report under Section 17 for United Kingdom Patent Application No. GB1319862.7, issued Apr. 15, 2014.

Great Britain Patent Office, Great Britain Search Report for Great Britain Patent Application No. 381319867.6, dated May 6, 2014.

* cited by examiner

A-A

MOTOR VEHICLE DOOR WITH TAMPER-PROOF SAFETY MECHANISM

CROSS-REFERENCE TO RELATED APPLICATION

This application claims priority to German Patent Application No. 10 2012 023 656.5, filed Nov. 28, 2012, which is incorporated herein by reference in its entirety.

TECHNICAL FIELD

The technical field relates to a motor vehicle door having a door lock and an actuating unit mechanically coupled to the door lock and with a tamper-proof safety mechanism.

BACKGROUND

Motor vehicle doors, which make possible entering the passenger cell of a motor vehicle, are to have a high degree of tamper-proof and anti-theft safety. Accordingly, various test standards exist which represent the various tampering scenarios, which the motor vehicle door should oppose with a maximum of resistance.

Thus, FIG. 1 and FIG. 2 show a popular closing mechanism of a motor vehicle door. Here, the motor vehicle door comprises a supporting door structure 12, on which an actuating unit 20 is arranged. Spaced from the actuating unit 20, a door lock 14 is provided, which can be releasably brought into engagement with a lock shackle provided on the body side which is not shown here.

The actuating unit 20 in this case is mechanically coupled to the door lock 14 by means of two connecting links 16, 18. Here, the connecting link 16 constitutes an actuating rod, by means of which with unlocked lock 14 for example through actuating a door handle 22 formed on the actuating unit 20 the lock 14 can be opened for releasing the lock shackle. The connecting link 16 thus transmits the mechanical movement of the handle 22 to the lock 14.

In addition, the lock 14 is lockable and unlockable via the further connecting link 18. For example, the connecting link 18 on the part of the actuating unit 20 is operationally connected to a locking cylinder or to a central locking device. Through a tension or compression loading of the connecting link 18, the door lock 14 can be optionally transferred from a locked into an unlocked configuration, or vice versa, from an unlocked into a locked configuration.

FIG. 1 furthermore shows a possible tampering scenario of the motor vehicle door according to the so-called Thatcham test. Using a tampering tool 44, a locking cylinder provided for example in the region of the door handle 22 can be pierced or forcibly pushed in. The tampering tool 44 rammed into the actuating unit 20 can then function as a lever. By pivoting for example the tampering tool 44 from the configuration shown in FIG. 1 downwards, the actuating unit 20 can be subjected to an approximately opposite yet noteworthy shift 46 and position change towards the top.

This position change furthermore can be accompanied by a tensile loading 48 of the connecting link 18, as a result of which the lock 14 is transferable for example from a locked into an unlocked configuration. Through a following actuation of the handle 22, the door could then be opened without problem and almost free of destruction.

Furthermore, a device for arresting a closing cylinder housing in a closing cylinder receptacle in a component mounted in a door is known from EP 1 176 271 A2. Here, a component, which can also carry the handle of the door, forms a receptacle for a closing cylinder housing. Here, the component furthermore forms a counter stop for a spreading tongue, which is pivotally mounted on the locking cylinder housing and, either by means of an additional spring or formation of spring steel, is force-loaded in the direction of spreading-out from the circumference of the closing cylinder housing. Such a device can protect the locking cylinder housing merely against tensile forces acting in cylinder longitudinal direction.

In this regard, at least one object is to provide a motor vehicle door with an improved burglar-proof safety mechanism or tamper-proof safety mechanism. This should be integratable into existing door configurations if possible and implementable with low production and assembly expenditure, if possible. The tamper-proof safety mechanism is to be characterized furthermore by a high mechanical strength and by a robust construction.

SUMMARY

The motor vehicle door provided in this regard comprises a supporting door structure and a door lock, with which the door can be brought into engagement with a lock shackle provided in the region of a door opening on the body side and accordingly is closeable or lockable. Furthermore, the motor vehicle door comprises an actuating unit, which is arranged on the door structure spaced from the door lock and with which at least one connecting link is mechanically coupled to the door lock.

The actuating unit in this case comprises for example a door handle that is actuatable by the end user and a closing cylinder or a comparable locking element in order to be able to optionally transfer the door lock which is operationally connected therewith into a locking or unlocking position. Both the actuating of a door handle and/or of a closing cylinder or of a central locking system can be transferred to the door lock in the provided manner by means of the at least one connecting element.

In addition, the motor vehicle door comprises a holding part supporting itself on the door structure, which is designed in order to limit a position change of the actuating unit due to external application of force. Here, the holding part is preferably formed separately from the actuating unit and functions as a tamper-proof safety mechanism. By effectively contributing to the position stabilization or position fixing of the actuating unit, the latter can merely be moved to a highly limited degree for example through forces acting from the outside relative to the door structure, but above all only to a very limited degree relative to the door lock.

The movement limitation of the actuating unit that is providable via the separate holding part can largely prevent or reduce a movement or tensile loading accompanied by this of the at least one connecting link that is operationally connected to the lock to a degree, that a movement of the connecting link, which is ultimately not entirely avoidable, is in no case sufficient for transferring the door lock for example out of a locking configuration into the unlocking configuration.

Here, the holding part can be formed as a movement-limiting stop but also as an anti-rotation safeguard for the actuating unit. In that the holding part is embodied as a separate component that is detached from or independent of the remaining functionality of the actuating unit, already existing motor vehicle door concepts can possibly be also provided or retrofitted with such a holding part. It is at least conceivable that the holding part can be implemented in existing motor vehicle door arrangements. Thus, already existing motor vehicle model series can be modified in the already running production with such a holding part for improving the anti-theft and tamper-proof behavior.

According to a further embodiment, the holding part is arranged adjoining the actuating unit on the door structure subject to adhering to a predetermine spacing. The holding part is embodied as a separate component relative to the actuating unit and is specifically and separately arranged on the door structure. In this regard, it constitutes a movement or position-limiting stop for the actuating unit. In that the holding part is arranged subject to maintaining a predetermined spacing from the actuating unit, the holding part during normal operation of the motor vehicle door has no influence on the functioning of the actuating unit and of the door lock operationally connected therewith whatsoever.

The predetermined spacing preferentially amounts to a few millimeters, in particular about 1 mm to about 5 mm, preferably about 2 mm to about 3 mm, so that taking into account invariable component and assembly tolerances a clear spacing between the actuating unit and the holding part assigned to it can be maintained. The arrangement of the holding part at a predetermined spacing from the actuating unit can counteract the development of possible noises caused through vibration.

Spacing between the holding part and the actuating unit however is dimensioned smaller than an actuating amplitude of a connecting link extending between the actuating unit and the door lock provided for unlocking the lock. The spacing between the actuating unit and the holding should therefore be dimensioned in such a manner that shifting or rotating of the actuating unit for example due to external application of force is blockable before an unlocking position of the lock is reached.

According to a further embodiment, the holding part has a shaping that corresponds to an outer contour portion of the actuating unit. Here it proves to be advantageous if the holding part and the outer contour portion of the actuating unit assigned to it or directly facing it come to mutually bear against one another over as large as possible an area. In this way, possible concentrated loads can be reduced and an external force otherwise leading to a position change of the actuating unit can be effectively counteracted.

According to a further embodiment, the holding part can project into an intermediate space formed between the actuating unit and the door structure at least in regions. Thus, the holding part can extend approximately wedge-like between an inside of the door structure and a corresponding portion of the actuating unit. In this regard, the holding part can also counteract a possible pulling-away force directed in vehicle transverse direction (y) and acting on the actuating unit.

In general, the holding part is designed in order to fix the actuating unit with respect to its position in a door plane formed by the door structure. With closed vehicle door, the door plane substantially extends in vehicle vertical direction (z) and in vehicle longitudinal direction (x), consequently parallel to the plane of a side window arranged in the region of the door.

According to a further embodiment it is provided that the holding part is assigned to a side of the actuating unit that faces away from the at least one connecting link. In this way, the holding part can effectively prevent that spacing between actuating unit and door lock is enlarged for example due to external application of force. Accordingly, the holding part can contribute to limiting in terms of amplitude possible tensile forces on the at least one connecting link caused in particular due to external application of force.

According to a further embodiment, the holding part can furthermore comprise a V-shaped or S-shaped cross-sectional geometry. Individual legs of a V or S-shaped cross-sectional geometry in this case can be connected to the door structure on the one hand and on the other hand facing the actuating unit be formed adapted to an outer contour portion of the actuating unit.

Naturally, the holding part should be formed as dimensionally stable as possible and in a flexurally and torsionally stiff manner. Advantageously, the holding part is therefore formed as a metal component, for example as a solid metal cast component. However, it is also conceivable to form the holding part from a comparatively dimensionally stable and consequently high-strength metal plate.

According to a further embodiment thereof, the holding part facing the actuating unit comprises a bearing leg, which substantially extends parallel to an outer contour portion of the actuating element located opposite. The shaping and orientation of stop leg and outer contour portion which correspond to one another makes possible a comparatively large bearing surface in the event of a load, so that any forces externally acting in the actuating unit can be absorbed as best as possible and discharged into the door structure.

With an approximately S-shaped configuration of the holding part, it is provided according to a further development that a center piece of the holding part adjoining the bearing leg substantially extends perpendicularly to the adjoining outer contour of the actuating unit. By means of an S-shaped configuration and with a centerpiece substantially extending perpendicularly to the outer contour portion of the actuating unit, a particular resistance is provided for the holding part to an external application of force. Furthermore, the dimensioning, in particular the size and/or the wall thickness of the holding part can be reduced in an advantageous manner for example for weight reduction through such a geometrical design.

According to a further embodiment, at least one reinforcement rib or reinforcement bead can also be provided in a transition region from the centerpiece to the adjoining bearing leg and/or to an adjoining fastening leg of the holding part. By introducing such a rib or a bead formed through stamping in the bent transition from the centerpiece to one of the adjoining legs, bearing legs or fastening legs, the flexural and torsional stiffness of the holding part can be further reinforced.

According to a further embodiment, the holding part is furthermore fastened to the door structure via at least two fastening points which are spaced from one another. A multiple fastening is provided for the holding part to the door structure, which can be fastened with adequate strength and structural stiffness to any supporting components of the door structure. Here it is provided in particular that the holding part is fastened to the door structure in a materially joined manner. In particular, the holding part can be multiply welded and/or glued to the door structure.

According to a further embodiment, the holding part can be connected in particular to a window well reinforcement of the door structure. The window well reinforcement in this case runs approximately horizontally, based on the vehicle vertical direction (z) approximately above the actuating unit. With a fastening leg facing the door structure, the holding part can for example be multiply fastened along the window well reinforcement, in particular welded thereto.

Additionally or alternatively holding part according to a further configuration can also be connected to a door outer panel via a further fastening point in a materially joined manner. The fastening point in this case can in particular be formed as a glued joint, so that the holding part for example at a predetermined spacing from the window well reinforcement is connectable in addition to a further component of the door structure, namely to an outer door panel. In this regard, the holding part which can be multiply fastened to different components of the door structure can also contribute to the structural stiffening of the entire door structure.

According to a further embodiment, a motor vehicle is finally provided, which comprises at least one previously described motor vehicle door with a holding part supporting itself on the respective door structure.

BRIEF DESCRIPTION OF THE DRAWINGS

The present invention will hereinafter be described in conjunction with the following drawing Figs., wherein like numerals denote like elements, and.

DETAILED DESCRIPTION

The following detailed description is merely exemplary in nature and is not intended to limit application and uses. Furthermore, there is no intention to be bound any theory presented in the preceding background or summary or the following detailed description.

Figure 1:
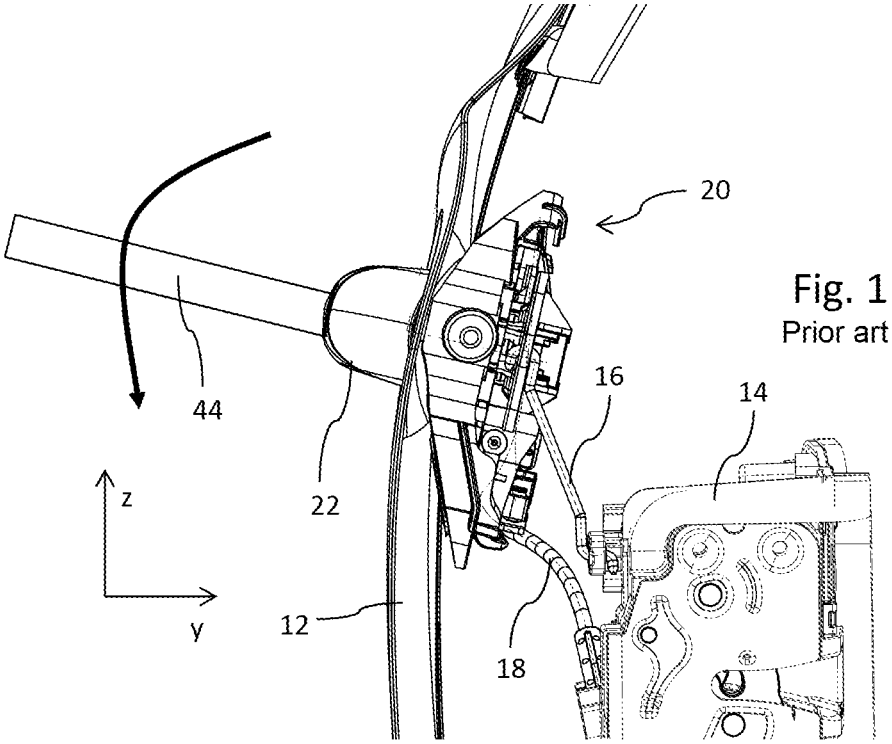
Fig. 1 Prior art
FIG. 1 a sectioned representation through a motor vehicle door according to the prior art.
Figure 2:
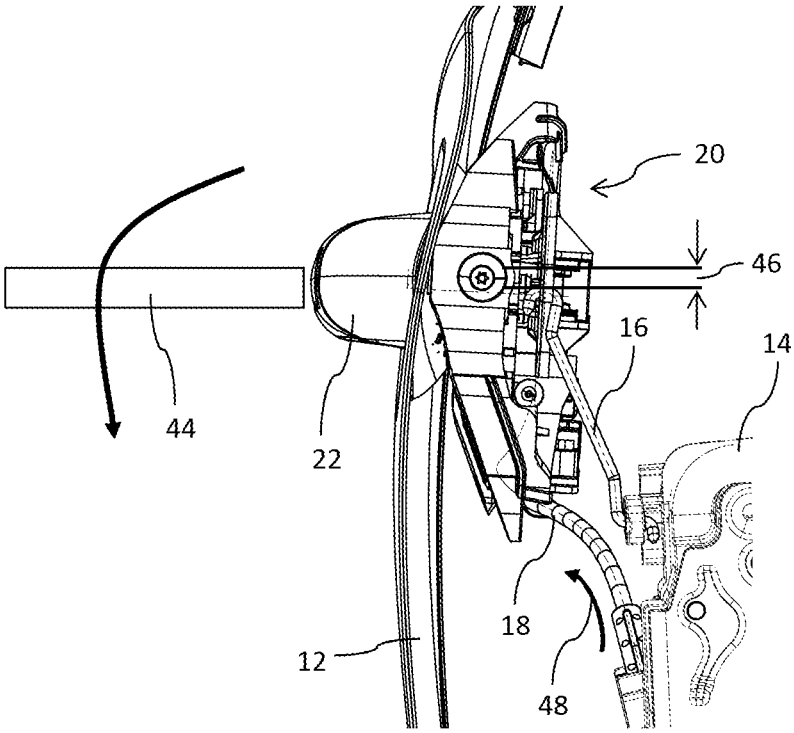
Fig. 2 Prior art
FIG. 2 a representation of the motor vehicle door according to FIG. 1 with an actuating unit levered upwards.
Figure 3:
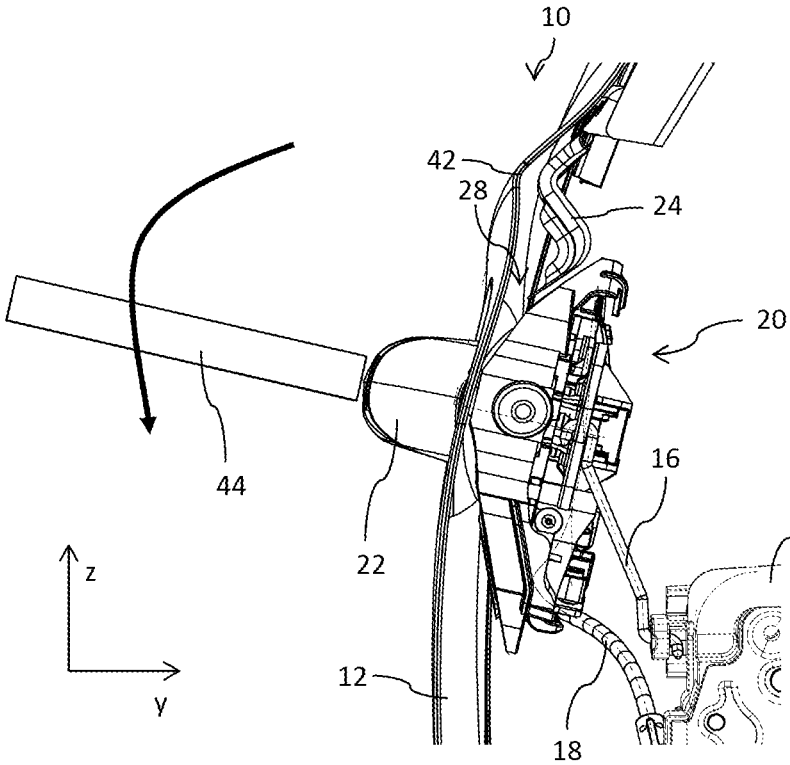
FIG. 3 a sectioned representation through a motor vehicle door with a holding part supporting itself on the door structure and providing a tamper-proof safety mechanism in a basic configuration.
Figure 4:
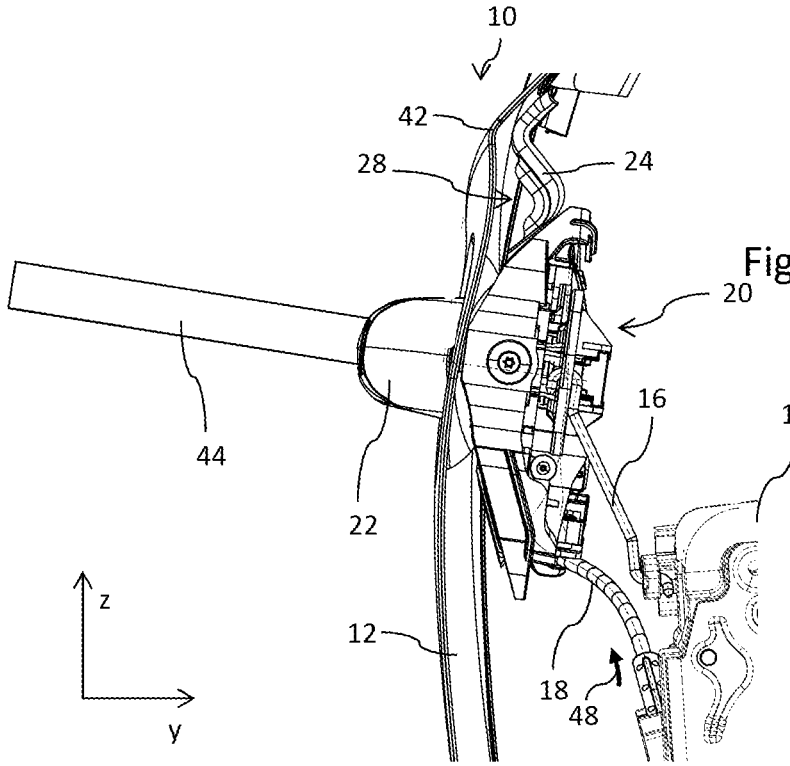
FIG. 4 a representation corresponding to FIG. 3 during or after an external application of force on the actuating unit of the motor vehicle door.

In the configuration of a motor vehicle door 10 shown in the FIG. 3 to FIG. 6, a holding part 24 formed approximately S-shaped in cross section is fastened to the door structure 12 above an actuating unit 20. Through this arrangement, a tampering attempt by means of a tampering tool 44 described in FIG. 1 and FIG. 2 can be effectively counteracted. Provided that in this case the tampering tool 44 is now moved from the basic position shown in FIG. 3 downwards, the actuating unit 20 can only be moved upwards by a significantly smaller dimension compared with the representation according to FIG. 2, namely until the actuating unit 20 comes to bear against a bearing leg 30 of the holding part 24 projecting downwards in a movement-limiting manner, such as is shown for example in FIG. 4.

In this regard, the holding part 24 has a movement-limiting and position-fixing effect on the actuating unit 20. At best, the actuating unit 20 can only be moved upwards by a comparatively small amount. Consequently, the connecting link 18 can only be shifted upwards by a correspondingly reduced amount with respect to its movement amplitude. A tensile load 48 on the connecting link 18 can be clearly reduced in this regard.

The tensile load 48 acting on the connecting link 18 as a result of the slight shifting of the actuating unit is not adequate for unlocking the door lock 14 and accordingly unsuitable. Consequently, the motor vehicle door 10 provided with such a tamper-proof safety mechanism cannot be opened with a method described and sketched in the FIG. 1 and FIG. 2.

Figure 6:
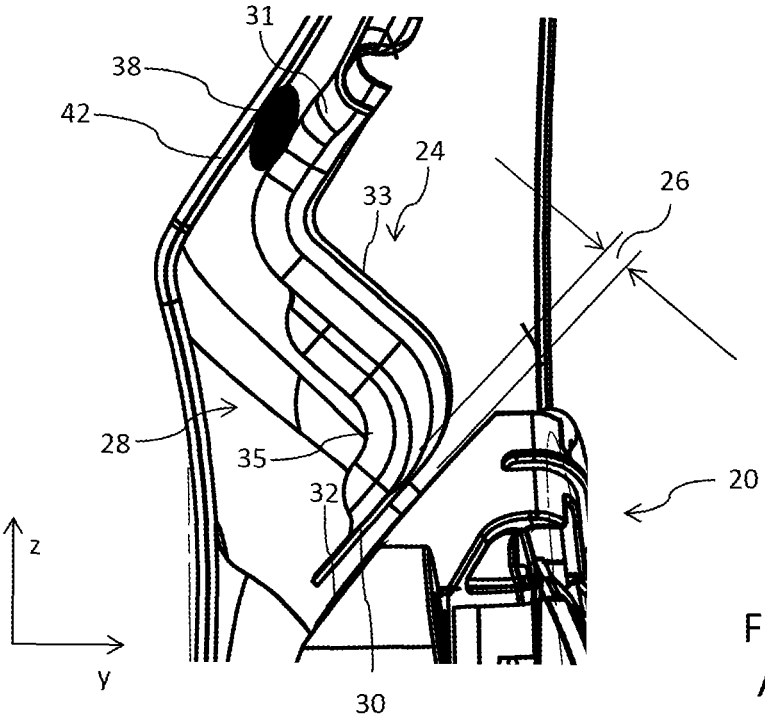
FIG. 6 an enlarged cross section along A-A through the holding part according to FIG. 5.

As shown in the enlarged representation according to FIG. 6, the holding part 24 comprises a bearing leg 30 running approximately parallel to an outer contour portion 32 of the actuating unit 20 located opposite. The bearing leg 30 and the outer contour portion 32 are arranged at a predetermined spacing 26 from one another in a basic position shown in FIGS. 3 and 6. At least in portions, they run substantially parallel to one another.

Furthermore, the bearing leg 30 extends at least in regions in an intermediate space 28 formed by door structure 12 and actuating unit 20. Thus, the outer contour portion of the actuating unit 20 projects slightly to the inside viewed in vehicle transverse direction (y), so that a type of undercut is formed, in which the bearing leg 30 of the holding part 24 can supportingly engage.

The already mentioned spacing 26 between bearing leg and outer contour portion in this case is dimensioned in such a manner that merely a minimal relative movement between actuating unit 20 and holding part 24 is possible, but which with respect to amplitude is not sufficient in order to unlock the door lock 14. The arrangement of actuating unit 20 and holding part 24 at a predetermined spacing 26 is advantageous with respect to invariable component and/or assembly tolerances and can counteract the development of interfering noises possibly brought about by vibration.

Adjoining the bearing leg 30, the holding part 24 comprises a centerpiece 33, which extends approximately perpendicularly to the outer contour portion 32 of the actuating unit 20. Because of this, the holding part 24 can provide a particularly high resistance force to a position change of the actuating unit 20 caused due to external application of force.

Figure 5:
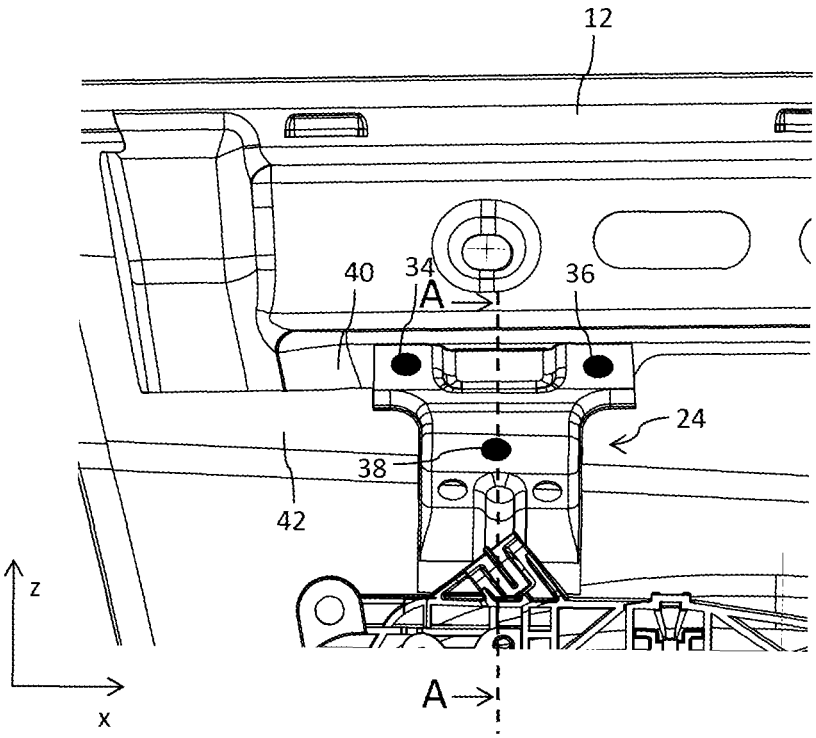
FIG. 5 a perspective representation of the holding part fastened to a window well reinforcement.

The transition region between the centerpiece 33 and the bearing leg 30 of the holding part 24 is furthermore provided with a reinforcement rib 35, which according to the representation according to FIG. 5 can also be formed as a recessed bead. By means of the reinforcement rib or bead 35, the structural stiffness and flexural strength of the holding part 24, taken in isolation, can be increased.

On the other end, facing away from the bearing leg 30, the holding part 24 comprises a fastening leg 31, which is connected to a supporting component of the door structure 12 with two fastening points 34, 36 spaced approximately in vehicle longitudinal direction (x). Preferably, the fastening leg 31 is directly welded to a window well reinforcement 40 of the door structure 12.

Spaced from this, a further fastening point 38 can be additionally provided, via which the fastening leg 31 can be glued for example to an outer door panel 42. Through the multiple fastening of the holding part 24, in particular to different components, such as for example the window well reinforcement 40 and the outer door panel 42 of the door structure 12, the structural stiffness of the door structure 12 as a whole can also be increased.

In addition, forces which are externally introduced into the actuating unit 20 via a tampering tool 44 can be particularly reliably discharged into the door structure 12 via the holding part 24 by way of the multiple fastening points 34, 36, 38 approximately arranged in a triangle.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A motor vehicle door, comprising:

a door structure;

a door lock;

an actuating unit is arranged on the door structure and spaced from the door lock, the door lock being positioned on a first side of the actuating unit;

at least one connecting link mechanically coupling the actuating unit to the door lock, wherein the at least one connecting link is configured to actuate the door lock with a predetermined tension force, and a holding part mounted on the door structure on a second side of the actuating unit, opposite the first side, wherein the holding part is initially spaced apart from the actuating unit at a predetermined distance when the actuating unit is in an untampered position, and wherein the holding part is configured to limit a position change of the actuating unit to the predetermined distance upon application of an external tampering force that pulls the actuating unit away from the door lock, and wherein the predetermined distance is selected such that any movement of the actuating unit results in a tension force on the at least one connecting link that is less than the predetermined tension force.

2. The motor vehicle door according to claim 1, wherein the holding part has a shape that substantially corresponds to an outer contour portion of the actuating unit.

3. The motor vehicle door according to claim 1, wherein the holding part projects into an intermediate space in between the actuating unit and the door structure.

4. The motor vehicle door according to claim 1, wherein the holding part has an S-shaped cross-sectional geometry.

5. The motor vehicle door according to claim 4, wherein the holding part facing the actuating unit comprises a bearing leg that extends substantially parallel to an outer contour portion of the actuating unit located opposite.

6. The motor vehicle door according to claim 5, wherein a centerpiece of the holding part substantially extends perpendicularly to the outer contour portion of the actuating unit.

7. The motor vehicle door according to claim 6, wherein at least one reinforcement rib is formed in a transition region is formed from the centerpiece to the bearing leg.

8. The motor vehicle door according to claim 6, wherein at least one reinforcement rib is firmed in a transition region is formed from the centerpiece to an adjoining fastening leg.

9. The motor vehicle door according to claim 6, wherein at least one reinforcement bead is formed in a transition region is formed from the centerpiece to the bearing leg.

10. The motor vehicle door according to claim 6, wherein at least one reinforcement bead is formed in a transition region is formed from the centerpiece to an adjoining fastening leg.

11. The motor vehicle door according to claim 1, wherein the holding part is fastened to the door structure via a first fastening point spaced apart from a second fastening point.

12. The motor vehicle door according to claim 1, wherein the holding part is connected to a window well reinforcement of the door structure.

13. The motor vehicle door according to claim 1, wherein the holding part is connected to an outer door panel in a materially joined manner.

14. The motor vehicle door according to claim 1, wherein the holding part has a V-shaped cross-sectional geometry.

* * * * *